US006132203A

United States Patent [19]

Masin

[11] Patent Number: 6,132,203

[45] Date of Patent: Oct. 17, 2000

[54] METHOD AND APPARATUS FOR BURNING OILS OF VARYING VISCOSITY

[76] Inventor: Radek Masin, 7589 Race Rd., N. Ridgeville, Ohio 44039

[21] Appl. No.: 09/186,545

[22] Filed: Nov. 5, 1998

[51] Int. Cl.[7] ..... F23D 11/38

[52] U.S. Cl. ..... 431/121; 431/3; 431/29; 431/32; 431/118; 137/239; 210/408; 210/411; 239/106; 239/114; 239/119

[58] Field of Search ..... 431/121, 122, 431/3, 29, 32, 117, 118, 207, 208, 11; 239/106, 114, 462, 110, 119, 120, 123, 590, 590.3; 122/380, 387, 388, 405; 137/15, 239, 240, 242; 210/407, 408, 409, 410, 411

[56] References Cited

U.S. PATENT DOCUMENTS

| | | | |
|---|---|---|---|
| 1,428,896 | 9/1922 | McDonald et al. . | |
| 2,602,006 | 7/1952 | Fahrbach | 239/462 |
| 2,818,110 | 12/1957 | Rulseh | 431/121 |
| 2,884,234 | 4/1959 | Gebhart et al. | 15/246.5 |
| 3,188,677 | 6/1965 | Jamison, Jr. | 122/380 |
| 3,337,052 | 8/1967 | Knieriem et al. | 210/409 |
| 3,379,375 | 4/1968 | Walkling et al. | 431/121 |
| 3,770,209 | 11/1973 | Wilcox | 239/434 |
| 4,141,505 | 2/1979 | Reich | 239/431 |
| 4,249,885 | 2/1981 | Reich | 431/38 |
| 4,402,664 | 9/1983 | Kutrieb | 431/79 |
| 4,438,882 | 3/1984 | Frehnet | 239/590.3 |
| 4,508,138 | 4/1985 | DIxon | 137/239 |
| 4,533,316 | 8/1985 | Takino et al. | 431/121 |
| 5,000,677 | 3/1991 | Lathion et al. | 431/187 |
| 5,149,260 | 9/1992 | Foust | 431/11 |
| 5,240,405 | 8/1993 | Schubach et al. | 431/62 |
| 5,341,832 | 8/1994 | Foust | 137/202 |
| 5,360,334 | 11/1994 | Kagi, Sr. | 431/1 |
| 5,405,261 | 4/1995 | Scraggs et al. | 431/171 |
| 5,462,429 | 10/1995 | Pritchard et al. | 431/121 |
| 5,531,212 | 7/1996 | Smoker et al. | 126/104 R |

FOREIGN PATENT DOCUMENTS

| | | | |
|---|---|---|---|
| 3-221712 | 9/1991 | Japan | 431/121 |

*Primary Examiner*—Ira S. Lazarus
*Assistant Examiner*—Josiah C. Cocks

[57] ABSTRACT

Disclosed is an oil burning system that is capable of burning oils of varying viscosities, including high viscosity waste oils and low viscosity heating oils. Suitable as a new installation or a retrofit modification, the present invention incorporates the use of a variable rate, high-pressure oil delivery system, along with an oil pre-heater, in conjunction with a modified high-pressure atomizing nozzle. Installed in a sliding drawer burner arrangement that allows for quick and easy access, the oil burning system also includes a means by which particulate matter and carbonization build-ups are removed from the burner nozzle automatically, thereby eliminating the need for frequent cleaning.

12 Claims, 7 Drawing Sheets

METHOD AND APPARATUS FOR BURNING OILS OF VARYING VISCOSITY

BACKGROUND OF THE INVENTION

1. Field of the Invention

The present invention relates generally to oil burning devices used to power low-pressure boilers, heating systems and the like, and more specifically to an oil burner configuration that allows for the burning of oils of varying viscosity while minimizing problems caused by sludge formation and clogging that are typical of conventional high viscosity and waste oil burning devices.

2. Description of the Related Art

In the United States alone, billions of gallons of waste oil are generated each year. Disposal of this oil is both costly and environmentally hazardous. While waste oil can be recycled and re-used for a variety of purposes, the process is complex, costly and nevertheless results in some quantity of non-recoverable materials that must be disposed of, posing the same environmental and health concerns as the outright disposal of the waste oil itself. As a result, many people choose to dispose of waste oil by burning it in order to generate heat for use in space heating, water heating or other general heating purposes in a residential or commercial environment. This is especially the case when referring to the higher volume producers of waste oils that wish to avoid the high cost of disposal. However, specialized waste oil burners can be expensive and cost prohibitive to many potential users. Furthermore, many of these potential users already employ the use of low viscosity heating oil burners, making the purchase of a specialized waste oil burning system unnecessarily redundant.

The present invention would overcome these drawbacks by providing an oil burning system capable of burning oils varying in viscosity from low viscosity heating oil to high viscosity waste oils. In an alternate embodiment, the present invention provides a modification means by which conventional heating oil burners can be retrofitted to accommodate higher viscosity and waste oil combustion. Use of the present invention will provide a safe, efficient, cost-efficient and environmentally sound method of waste oil disposal.

The majority of high viscosity and waste oil burners operate in a similar manner, according to a variety of widely accepted combustion control practices and principles. The waste oil is passed through a mechanical filtration device in order to remove any particulate matter suspended therein. The oil is then preheated in order to lower the viscosity of the fuel to a point where it can be effectively delivered to the combustion chamber. Once heated to the appropriate level, the oil is delivered to a nozzle by a pump of either positive or variable displacement. As the oil is sprayed through the nozzle it is atomized, that is mixed with air or steam in order to produce a fine mist of oil droplets, in order to achieve a complete and efficient oil burn. Atomization can be achieved in a variety of manners, including introduction of the atomizing media in the nozzle itself or by creating turbulence in the forced combustion air as it enters the combustion chamber and mixes with the fuel. The atomized fuel is ignited by constant-spark electrodes due to the fact that the fuel will not support self-sustained combustion. In order to compensate for the fact that waste oils can vary in viscosity, the preheating must be adjustable so as to allow the oil to be heated to the appropriate temperature. Control of the waste oil burners can be achieved by varying the volume of the fuel and air delivered to the combustion chamber, although most conventional waste oil burners do not provide any means to do so. Furthermore, the preheating of the waste oil must be adjustable to accommodate oils of varying viscosity.

While there are many existing designs for waste oil burning apparatuses disclosed throughout the art that generally fall within the aforementioned design criteria, they all suffer, alone or in combination, from a variety of problems associated with the use thereof.

Many conventional waste oil burners do not include a means by which to regulate the oil flow rate through the nozzle. Since oils of varying viscosity pressurized equivalently will flow at different rates, the result is that a high viscosity fuel will burn at a slower rate than a low viscosity fuel. Also, over-firing, which leads to overheating that could cause a fire or explosion, and under-firing, which causes decreased efficiency and poor emissions, cannot be prevented or otherwise controlled. In fact, many waste oil burner designs intentionally limit the oil flow rate in order to prevent over-firing, thus limiting BTU output. As a result, these devices are inflexible, limit the types of fuel that can be burned, and essentially prohibit the use of heating oil therein.

Waste oil burners require preheating in order to lower the viscosity of the fuel to a point where it will flow more freely and can be atomized more thoroughly. However, heating waste oil often leads to carbonization, commonly referred to as "sludging," wherein the oil assumes a thick, tar-like consistency that can clog delivery lines, nozzles, filtering screens and forms a thick buildup on the interior surfaces of the heating tank. As a result, the oil burning components must be routinely cleaned, often requiring the disassembly of the apparatus and producing prolonged down-time.

Most waste oil burners require the presence of an atomizing medium, usually compressed air or steam, that is introduced and mixed with the oil at the burner nozzle in order to produce well dispersed, fine fuel droplets. The use of atomizing media requires the incorporation of an external compressor, which adds to the overall costs of the unit and presents another mechanical piece of equipment that must be maintained.

In the ancillary art, there are several waste oil burning devices that are considered related, but exhibit the aforementioned problems towards which the present invention is directed and solves.

Several patents disclose oil burners and/or nozzles, for use with heating oils, fuel oils, and heavy or waste oils, that utilize a variety of atomization configurations and mediums:

U.S. Pat. No. 1,428,896, issued in the names of McDonald and Haynes, discloses a fuel oil burner nozzle design that incorporates the use of pressurized steam as an atomizing medium. U.S. Pat. Nos. 4,141,505 and 4,249,885, both issued in the name of Reich, disclose a heavy fuel oil burner nozzle design that incorporates the use of a pressurized atomizing fluid, introduced to the fuel stream at a right angle in order to produce a shearing force that will produce enhanced atomization. U.S. Pat. No. 5,000,677, issued in the name of Lathion et al., discloses an atomizing liquid fuel burner design that incorporates the use of a pressurized air to atomize the fuel. U.S. Pat. No. 5,149,260, issued in the name of Foust, discloses an atomizing liquid fuel burner design that incorporates the use of a pressurized air to atomize the fuel. The Foust burner includes a complex circulation system for both the fuel and the atomization air in which both are preheated in order to enhance combustion. All of the above listed devices will require an external source for the pressurization and delivery of the atomization media which, as previously discussed, adds to the cost, complexity, and maintenance of the unit. Also, none of these patents disclose any means by which they can easily be cleaned of carbonization build-ups nor any means by which these build-ups are prevented.

U.S. Pat. No. 5,341,832, issued in the name of Foust, discloses an atomizing waste oil burner design that incorporates the use of a pressurized air to atomize the fuel. The burner nozzle design incorporated in this design includes a linearly actuated needle inside the discharge head of the nozzle that serves as a means by which to clean the injection orifice and to regulate the oil flow therethrough. This design also requires an external source for the pressurization and delivery of the atomization media which will add to the cost, complexity, and maintenance of the unit. Also, while this design does address the need to clean the injection nozzle, it does not address nor discuss any means by which to clean other burner assembly components such as filter screens, the nozzle interior housing, transfer or delivery lines.

U.S. Pat. No. 5,360,334, issued in the name of Kagi, Sr., discloses a waste oil burner that incorporates the use of a piston-pump for fuel delivery and atomization. The piston-pump delivers the fuel at an extremely high pressure, causing the fuel to atomize sufficiently when sprayed through the nozzle without the aid of any other atomizing media. The speed and stroke of the piston-pump are adjustable, allowing the fuel flow to be regulated in order to compensate for the flow characteristics of fuels of varying viscosity. While this invention addresses the problems associated with atomization media and the need to allow for variable fuel flow, it does not address the need to account for carbonization build-up. Also, the use of a piston-pump presents inherent difficulties in delivering the fuel at a constant flow rate due to the differential in pressures created between the forward stroke and back stroke of the piston.

U.S. Pat. No. 5,405,261, issued in the name of Scraggs, et al., discloses a waste oil heater, incorporating the use of an atomizing fuel nozzle, with an improved combustion chamber in which two firing stages help to ensure a more complete burn of the fuel. While this design very well may be an effective means to ensure a more complete burn, it does not address nor prevent the aforementioned problems associated with atomization media, fuel carbonization and the regulation of fuel flow rates.

U.S. Pat. No. 5,531,212, issued in the name of Smoker et al., discloses a multi oil furnace in which a conventional aspiration nozzle burner is incorporated into a combustion chamber designed to maximize heat transfer. Again, while this design very well may be an effective means to ensure a more efficient heat transfer, it does not address nor prevent the aforementioned problems associated with atomization media, fuel carbonization and the regulation of fuel flow rates.

While several features exhibited within these references are incorporated into this invention, alone and in combination with other elements, the present invention is sufficiently different so as to make it distinguishable over the prior art. Consequently, a need has been felt for a means by which oils, varying in viscosity from heating oil to heavy and waste oils, can be burned efficiently while minimizing or eliminating altogether the problems associated with the use of atomization mediums, the carbonization of the oil, and control of the flow rate through the burner nozzle.

SUMMARY OF THE INVENTION

Oil burning furnaces perform a wide variety of functions in both commercial and residential environments. Ranging in magnitude from large industrial furnaces used to fire boilers and the like to small space-heating configurations, the burners incorporated in these designs are typically designed to burn a specific type of fuel, most often heating grade oils. Many of these establishments, however, desire to make use of low-grade, high viscosity oils and waste oils and are prohibited from doing so economically, due to the fact that the equipment required to burn these types of fuels is generally expensive. As a result, many potential users cannot afford to maintain both conventional heating oil burning equipment and high viscosity or waste oil burning equipment.

The present invention solves these problems by providing an oil burning system that is capable of burning oils of varying viscosities, including high viscosity waste oils and low viscosity heating oils. The present invention incorporates the use of a variable rate, high-pressure oil delivery system in conjunction with an atomizing nozzle that does not require the use of a separate of auxiliary aspiration medium. The present invention overcomes the aforementioned problems associated with the pre-heating of high viscosity and waste oils, the accumulation of sludge and the clogging of the burner nozzle by the incorporation of several features. The pre-heating oil tank includes a plunger actuated scraping device that removes sludge from the sidewalls of the tank, allowing it to be collected in a particulate filter from which it can be discarded. The burner nozzle is specially designed to collect particulate matter in a wire mesh strainer incorporated within the nozzle. However, cleaning of the strainer does not require disassembly of the burner assembly. Rather, a purging air line, equipped with a solenoid shutoff valve, is incorporated in the nozzle assembly, allowing the strainer to be purged clean and back flushed into a blowdown tank. The blowdown tank is piped to a three-way solenoid valve that, in the normal position, delivers fuel from the heating tank to the burner nozzle. In the purge position, the valve directs the piping connected to the burner nozzle to the blowdown tank. Thus, during the purge cycle, the purge air blows the strainer clean of particulate matter which is delivered to the blowdown tank. The purge cycle is performed upon routine shutdowns of the burner.

The burner system disclosed in the present invention is equally suited for new installations and for retrofit modifications of many existing burner systems. In a retrofit scenario, the burner nozzle is replaced and the airline and shutoff valve are installed. The three-way valve and blowdown tank will be installed either by splicing into the existing oil delivery line or installing a new line altogether. If the existing system does not include fuel pre-heating means, the fuel pre-heating tank will be installed between the existing fuel delivery pump and the three-way valve. As a result, the fuel limitations of the prior configuration is overcome, allowing for the burning of fuels of varying viscosities at a fraction of the cost of the purchase of a new, separate burner configuration.

Accordingly, it is an object of the present invention to provide an oil burner configuration that allows for the burning of oils of varying viscosity, including high viscosity and waste oils.

It is another object of the present invention to provide an oil burner configuration that allows for the pre-heating of high viscosity and waste oils in order to lower its viscosity in order to improve the flow and aspiration characteristics thereof.

It is another object of the present invention to provide an oil burner configuration that incorporates the use of a variable rate, high pressure oil delivery system in conjunction with a high pressure fuel oil burner nozzle that does not require the use of a separate or auxiliary aspiration medium.

It is another object of the present invention to provide an oil burner configuration that minimizes problems caused by sludge formation and clogging that are typical of conventional high viscosity and waste oil burning devices.

It is another object of the present invention to provide an oil burner configuration in which a variety of existing heating oil burning systems can be retrofitted to allow for the burning of high viscosity and waste oils.

It is another object of the present invention to provide an oil burner configuration, the retrofit installation of which will result in a considerable cost savings over the purchase of a separate high viscosity and waste oil burning system.

It is another object of the present invention to provide an oil burner configuration that does not require disassembly in order to clean the nozzle and remove carbonized particulate matter therefrom.

It is another object of the present invention to provide an oil burner configuration in which the nozzle incorporates an air purging means by which particulate matter, which poses the possibility of causing clogging, can be removed therefrom and delivered to a separate blowdown tank.

It is another object of the present invention to provide an oil burner configuration that is easily installed in both new and retrofit situations.

Finally, it is an object of the present invention to provide an oil burner configuration that is intrinsically safe and prevents the possibility of fire or explosion.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | | | |
|---|---|---|---|
| 20 | Conventional Oil Burner | 55 | Oil Flow Aperatures |
| 21 | Oil Supply Tank | 56 | Tank Scraping Spring |
| 22 | Fuel Delivery Pump | 60 | Purging Burner Nozzle |
| 23 | Fuel Isolation Valve | 61 | Nozzle Holder |
| 24 | Oil Burner | 62 | Nozzle Head |
| 25 | Fuel Delivery Conduits | 63 | Spray Aperature |
| 30 | Multi-Oil Burner | 64 | Oil Fitting |
| 31 | Oil Pre-Heater | 65 | Purge Air Fitting |
| 32 | Cleaning Plunger | 66 | Nozzle Head Interior Cavity |
| 33 | Air Compressor | 70 | Nozzle Holder Interior Cavity |
| 34 | Purge Air Isolation Valve | 71 | Nozzle Strainer |
| 35 | Air Lines | 72 | Nozzle Head Inlet Aperatures |
| 36 | Fuel Isolation/Purge Valve | 73 | Purge Air Conduit |
| 37 | Blowdown Tank | 80 | Sliding Drawer Burner |
| 40 | Pre-Heater Tank | 81 | Burner Housing |
| 41 | Pre-Heater Tank Lid | 82 | Combustion Air Fan |
| 42 | Pre-Heater Tank Lid Fasteners | 83 | Air Inlet Duct |
| 43 | Oil Inlet | 84 | Burner Duct |
| 44 | Oil Outlet | 85 | Furnace Combustion Chamber |
| 46 | Heating Element | 86 | Air Spinner |
| 50 | Cleaning Plunger Assembly | 87 | Constant Spark Ignitor |
| 51 | Plunger Handle | 90 | Horizontal Support Bars |
| 52 | Plunger Stem | 91 | Sliding Support Bushings |
| 53 | Cleaning Plunger Fitting | 92 | Furnace Sidewall |
| 54 | Tank Cleaning Rings | | |

DESCRIPTION OF THE PREFERRED EMBODIMENTS

Detailed Description of the Figures

Figure 1:
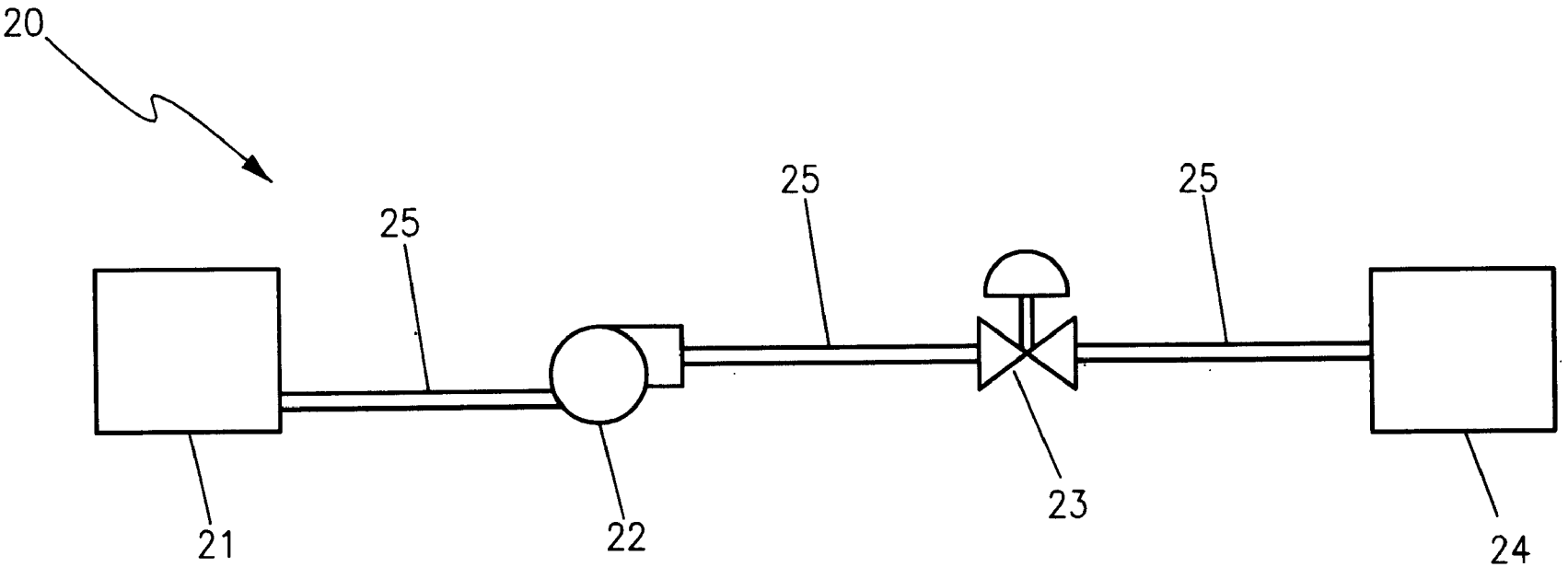
FIG. 1 is a diagrammatic view of a conventional oil burner and fuel delivery system.

Referring now to FIG. 1, depicted is a diagrammatic view of a conventional oil burner and fuel delivery system, hereinafter conventional oil burner 20, that is used to burn low viscosity heating oil. Although conventional oil burners assume a variety of configurations, utilizing equipment of varying functionality and complexity, the depiction in FIG. 1 is illustrative of and gives a general overview of the processes involved. The conventional oil burning configuration 20 consists of an oil supply tank 21 in fluid communication with a fuel delivery pump 22, the discharge of which is connected to a fuel isolation valve 23 that leads to an oil burner box assembly, hereinafter oil burner 24. The aforementioned connections are made with fuel delivery conduits 25 that can consist of a variety of fluid transport conduits, including piping and hoses constructed of a variety of materials. The oil supply tank 21 stores the heating oil for delivery to the burner by the fuel delivery pump 22. No pre-heating of the heating oil is necessary due to its low viscosity characteristics. The fuel delivery pump 22 creates a positive pressure in the fuel delivery conduits 25 leading to the oil burner box 24, where the fuel is atomized, mixed with combustion air and ignited. The incorporation of the fuel isolation valve 23 allows the fuel to the burner to be shut-off when the oil burner box 24 is shut down, helps prevent nozzle drip and also serves a safety purpose in preventing fire or explosion.

Several factors can contribute to the uniqueness of any particular conventional oil burning configuration 20. For example, many conventional oil burning configurations 20 incorporate the use of aspirating burner nozzles (not shown) that make use of an atomizing medium, usually air or steam, to promote a 20 more complete atomization and therefore a more efficient fuel burn. Also, the use of variable speed, positive discharge pumps for the fuel delivery pump 22 or the use of a variable displacement pump for the fuel delivery pump 22 in conjunction with a variable position control valve for the fuel isolation valve 23 allows for variable fuel delivery rates to the oil burner box 24 and thereby allows control of the flame intensity generated thereby. Furthermore, complex automation systems (not shown), incorporating the use of data gathering instrumentation, allow for the use of computerized, micro-processor based controllers to control process variables such as fuel flow, atomization medium delivery and combustion air flow through the use of remotely controllable variable speed motor and motor or solenoid actuated valves.

Figure 2:
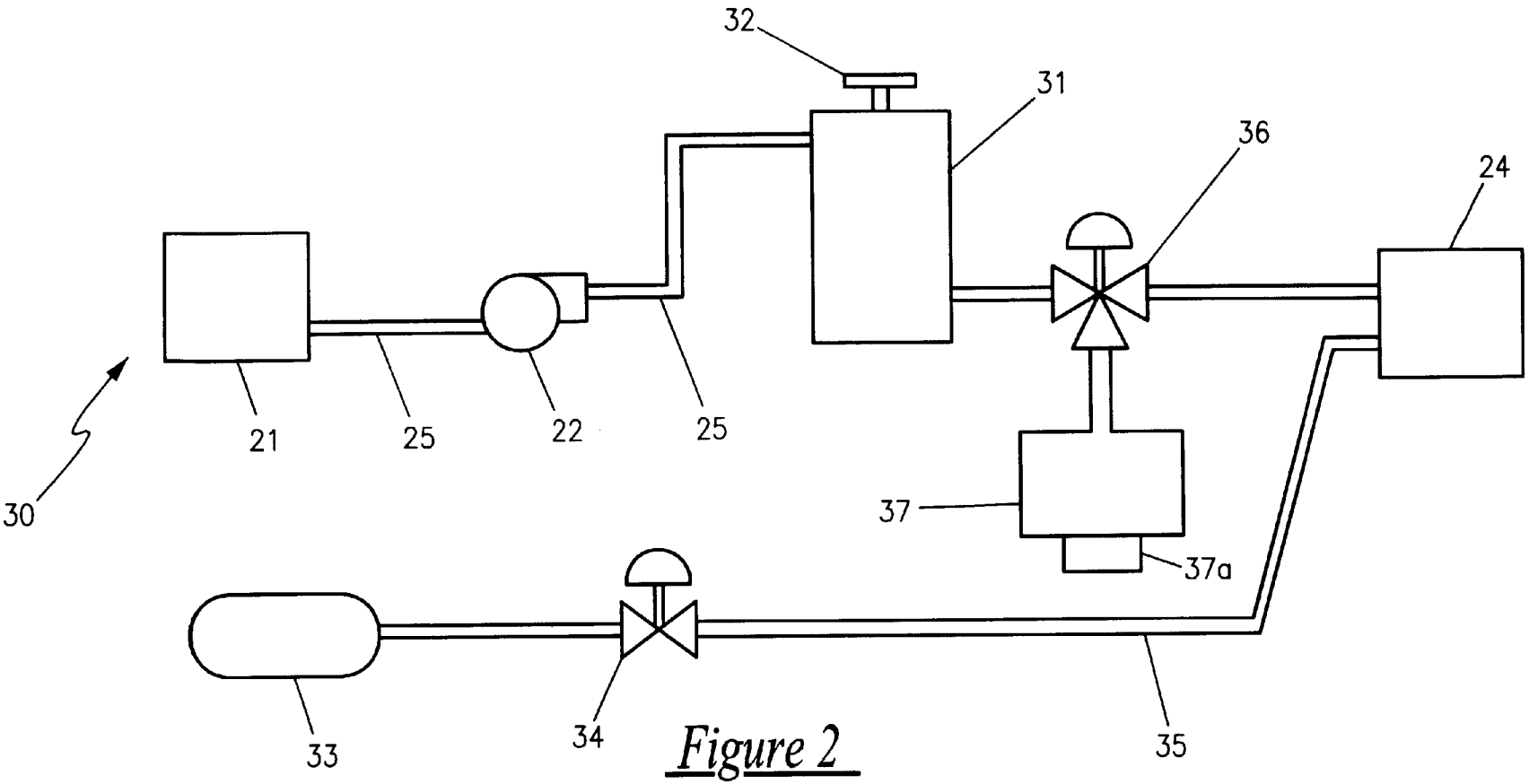
FIG. 2 is a diagrammatic view of an improved oil burner and fuel delivery system, according to the preferred embodiment of the present invention.

Referring now to FIG. 2, depicted is a diagrammatic view of the present invention, an oil burner configuration that allows for the burning of oils of varying viscosity, hereinafter referred to as a multi-oil burner 30. It should be noted that, in comparing the conventional oil burner 20 to the multi-oil burner 30, the devices have many components in common, namely the oil supply tank 21, the fuel delivery pump 22, the oil burner box 24 and the fuel delivery conduits 25. In addition to the common components, the multi-oil burner 30 incorporates several features that allow the burning of high viscosity and waste oils while minimizing the problems associated with the accumulation of carbonization. An oil pre-heater 31 is used to heat the higher viscosity oils to an elevated temperature, which results in a reduction in fuel viscosity, promoting enhanced fuel flow and atomization. The oil pre-heater 31 includes a cleaning plunger 32 that, when actuated, causes the removal of carbonization build-upon the interior sidewalls thereof, a process that will be described in greater detail herein below. An air compressor 33 provides pressurized air to the oil burner box 24 for the purpose of blowing clean and purging carbonization from the burner nozzle (not shown in FIG. 2), a process that will be discussed in greater detail herein below. A purge air isolation valve 34 allows the delivery of purge air from the air compressor 33 to be controlled. The purge air is delivered from the air compressor 33, through the purge air isolation valve 34 and to the oil burner box 24 via air lines 35, consisting of piping or hoses of suitable material construction. In the multi-oil burner 30 configuration, a three-way fuel isolation/purge valve, hereinafter fuel isolation/purge valve 36, replaces the fuel isolation valve 23. The purpose of the fuel isolation/purge valve 36 is to allow carbonization and other particulate matter to be blown into a blowdown tank 37 during the burner nozzle purge stage. A blowdown tank draining means 37*a* is provided to remove the accumulated particular matter on a periodic basis.

Figure 3:
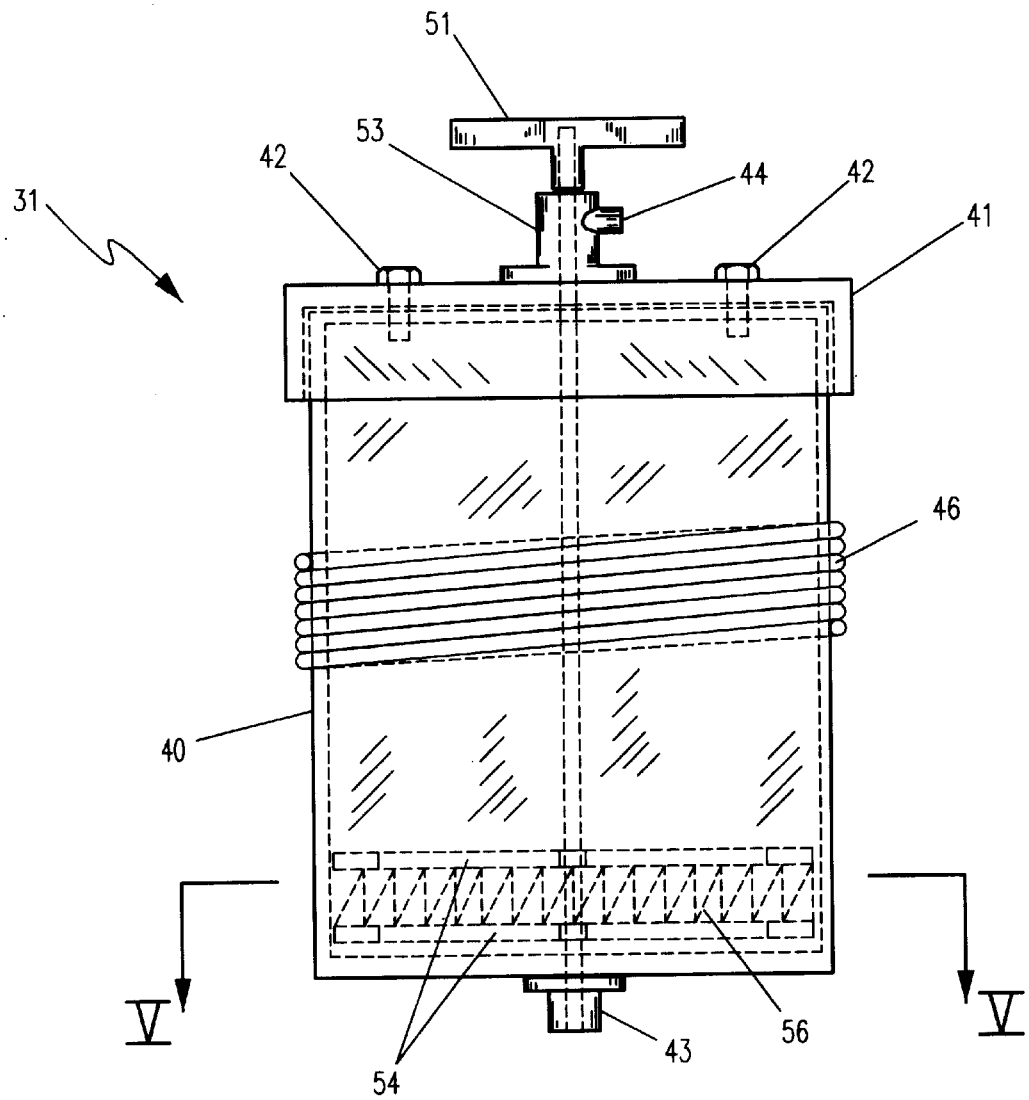
FIG. 3 is a side view of an oil pre-heating tank, according to the preferred embodiment of the present invention.
Figure 4:
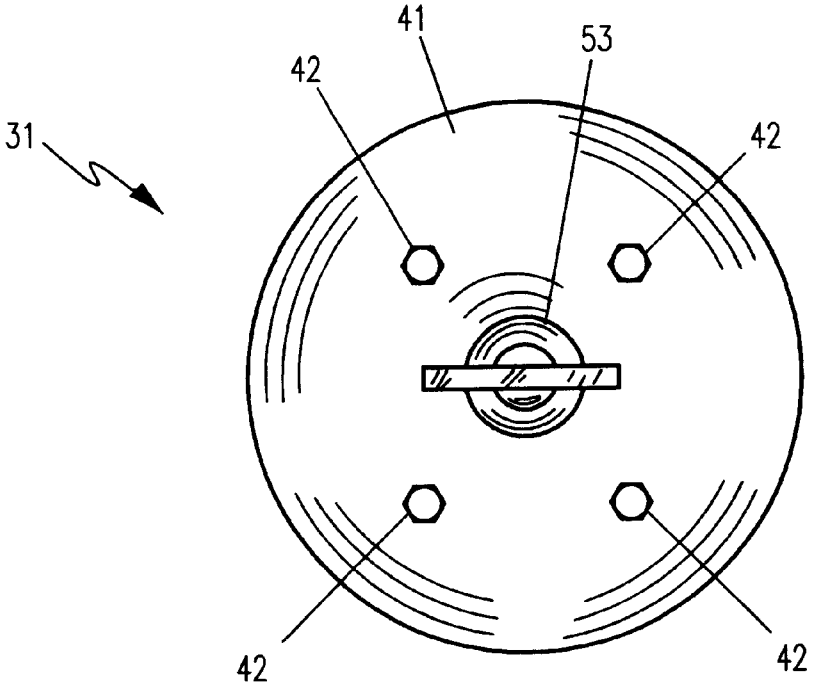
FIG. 4 is a top view of an oil pre-heating tank, according to the preferred embodiment of the present invention.
Figure 5:
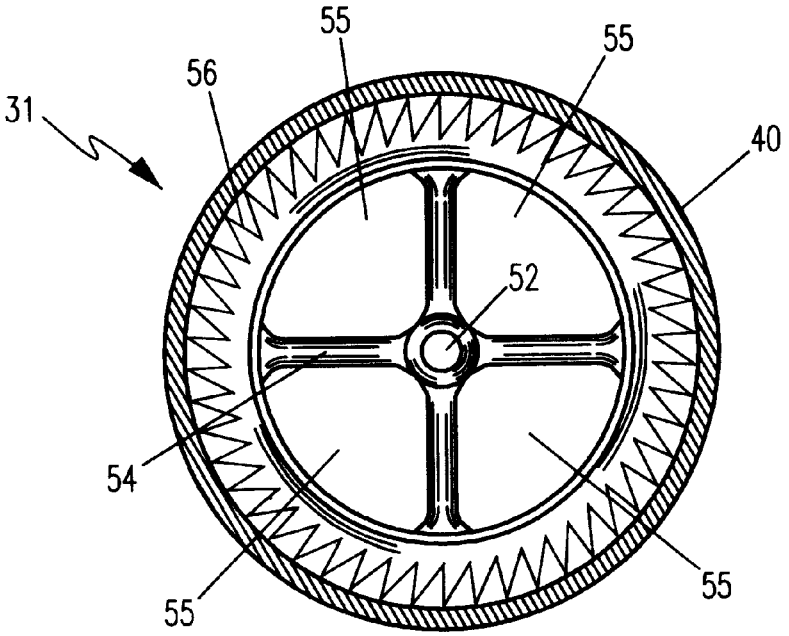
FIG. 5 is a side sectional view of an oil pre-heating tank taken along line V—V depicted in FIG. 3, according to the preferred embodiment of the present invention.

Referring now to FIGS. 3–5, depicted is the oil pre-heater 31, according to the preferred embodiment of the present invention. The oil pre-heater 31 consists of a pre-heater tank 40 with a pre-heater tank lid 41 secured thereto by a plurality of pre-heater tank lid fasteners 42 or by a welded seam (not shown), forming a hermetic seal. The pre-heater tank 40 has an oil inlet 43, consisting of a flange type pipe fitting, tube fitting or the like used to connect to the discharge of the fuel delivery pump 22 in order to supply the pre-heater tank 40 with fuel from the oil supply tank 21. The pre-heater tank 40 has an oil outlet 44, consisting of a T-type pipe fitting, tube fitting or the like used to connect to the fuel isolation/purge valve 36 in order to supply fuel to the oil burner box 24. An oil heater, consisting of a flexible rope-type heating element, hereinafter heating element 46, is wrapped around the exterior of the pre-heater tank 40. Heating the pre-heater tank 40 from the outside lowers the watt density by spreading the heat over a maximum surface area, thereby reducing the amount of carbonization. Depending upon the degree to which the oil must be heated, the heating element 46 may vary in length and can be wrapped around the pre-heater tank 40 from top to bottom, if necessary. The heating element 46 includes a thermostat (not shown) that allows for setting the target temperature for the oil contained in the oil pre-heater 31 to a temperature in the range of 100–300 degrees Fahrenheit.

As oil is heated in the oil pre-heater 31 it tends to carbonize, causing build-ups to develop on the interior surfaces thereof. In order to allow for the easy removal of such build-ups, the oil pre-heater 31 includes a cleaning plunger assembly 50. The cleaning plunger assembly 50 consists of a plunger handle 51, connected to a plunger stem 52 that extends vertically down into the interior cavity of the pre-heater tank 40, through a cleaning plunger fitting 53, allowing the plunger stem 52 to slide freely therein in a longitudinal direction, while forming a hermetic seal therewith. The plunger stem 52 is of a length sufficient to allow it to reach the bottom of the pre-heater tank 40. A pair of tank cleaning rings 54 are attached to the bottom of the plunger stem 52. The tank cleaning rings 54 are generally disc-like in shape and are of a diameter sufficient to allow them to slide freely in the pre-heater tank 40 with minimal clearance, and have oil flow apertures 55 spaced thereabout. The tank cleaning rings 54 are separated by a tank scraping spring 56 arranged longitudinally about the circumference of the tank cleaning rings 54. The tank scraping spring 56 is of a size such that compression thereof is required in order to fit inside the pre-heater tank 40. As a result, the tank scraping spring 56 biases itself against the sidewalls of the pre-heater tank 40, allowing it to remove carbonization build-up from the sidewalls as the cleaning plunger assembly 50 is actuated.

Figure 6:
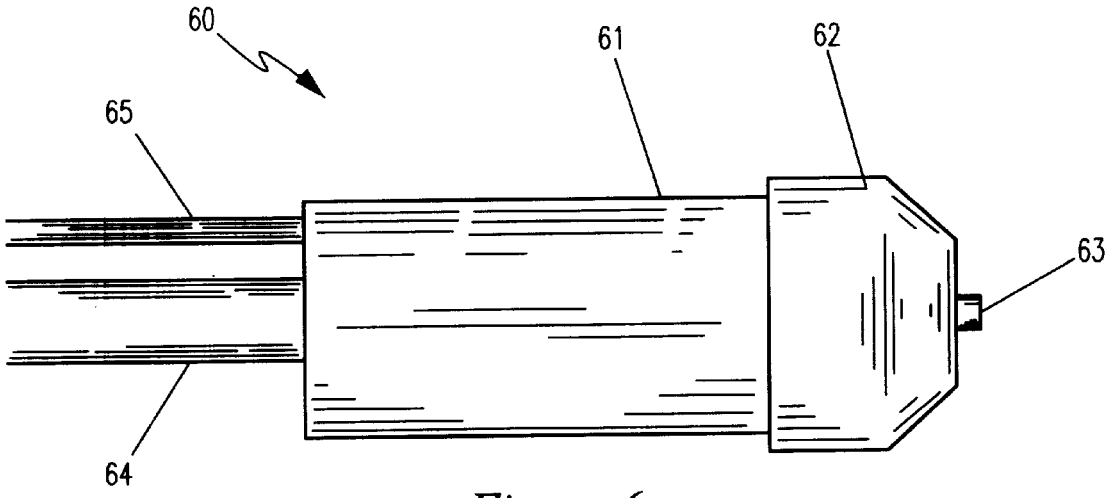
FIG. 6 is a side view of an air-purged, high-pressure, oil-burning nozzle, according to the preferred embodiment of the present invention.
Figure 7:
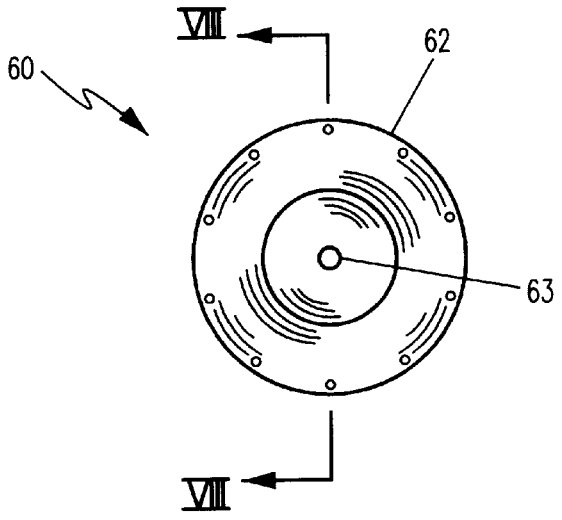
FIG. 7 is an end view of an air-purged, high pressure, oil-burning nozzle, according to the preferred embodiment of the present invention.
Figure 8:
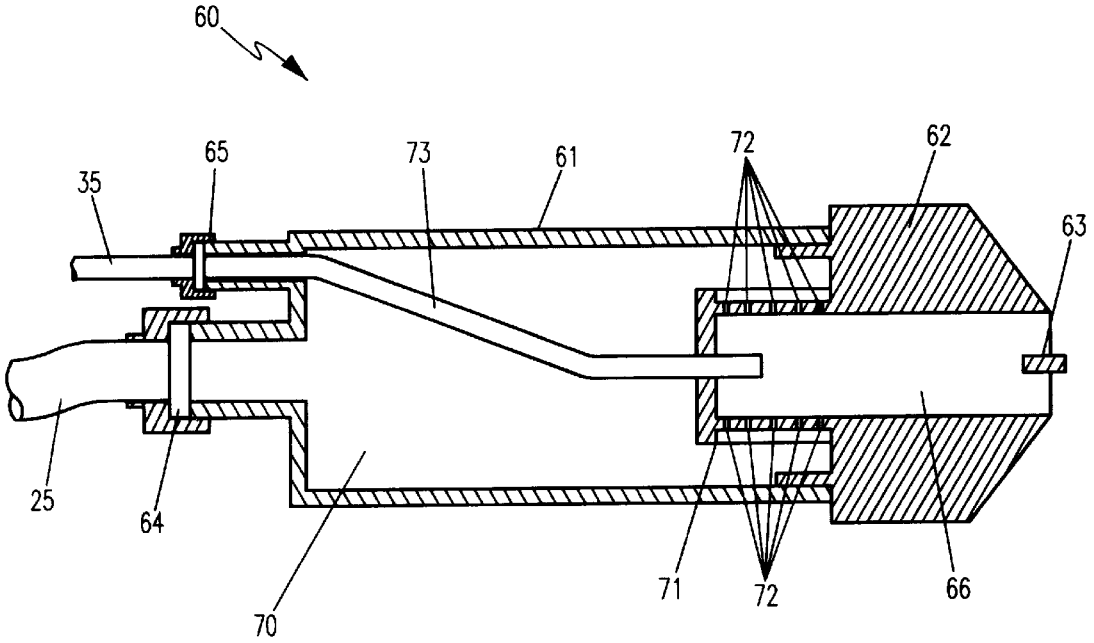
FIG. 8 is a side section view of an air-purged, high pressure, oil-burning nozzle taken along line VIII—VIII, according to the preferred embodiment of the present invention.

Referring now to FIGS. 6–8, depicted is purging burner nozzle 60, according to the preferred embodiment of the present invention. The purging burner nozzle 60 consists of a nozzle holder 61 with a removable nozzle head 62 attached to the end thereof. The nozzle head 62 includes a spray aperture 63 through which atomized oil is sprayed. Located opposite the nozzle head 62 and connected to the nozzle holder 61 are an oil fitting 64 and a purge air fitting 65, through which fuel and purge air are delivered via fuel delivery conduits 25 and air lines 35, respectively.

The interior construction of the purging burner nozzle 60 allows for the back-flushing or purging of particulate matter therefrom. As the oil enters the nozzle holder interior cavity 70 through the oil fitting 64, it fills the cavity and passes through a nozzle strainer 71, consisting of a wire mesh screen, that is used to filter particulate matter in the fuel before it passes through a plurality of nozzle head inlet apertures 72, entering the nozzle head interior cavity 66 and the spray aperture 63. A purge air conduit 73 is connected to the purge air fitting 65 extending through the nozzle holder interior cavity 70 and entering the nozzle head interior cavity 66, terminating therein. Thus, when pressurized air is forced therethrough, any particulate matter as well as any carbonization build-up on the nozzle strainer 71 will be blown off, or purged therefrom. This nozzle purging procedure will greatly extend the usage of the nozzle strainer 71, thus minimizing the need for disassembly of the purging burner nozzle 60 for cleaning or replacement of the nozzle strainer 71.

Figure 9:
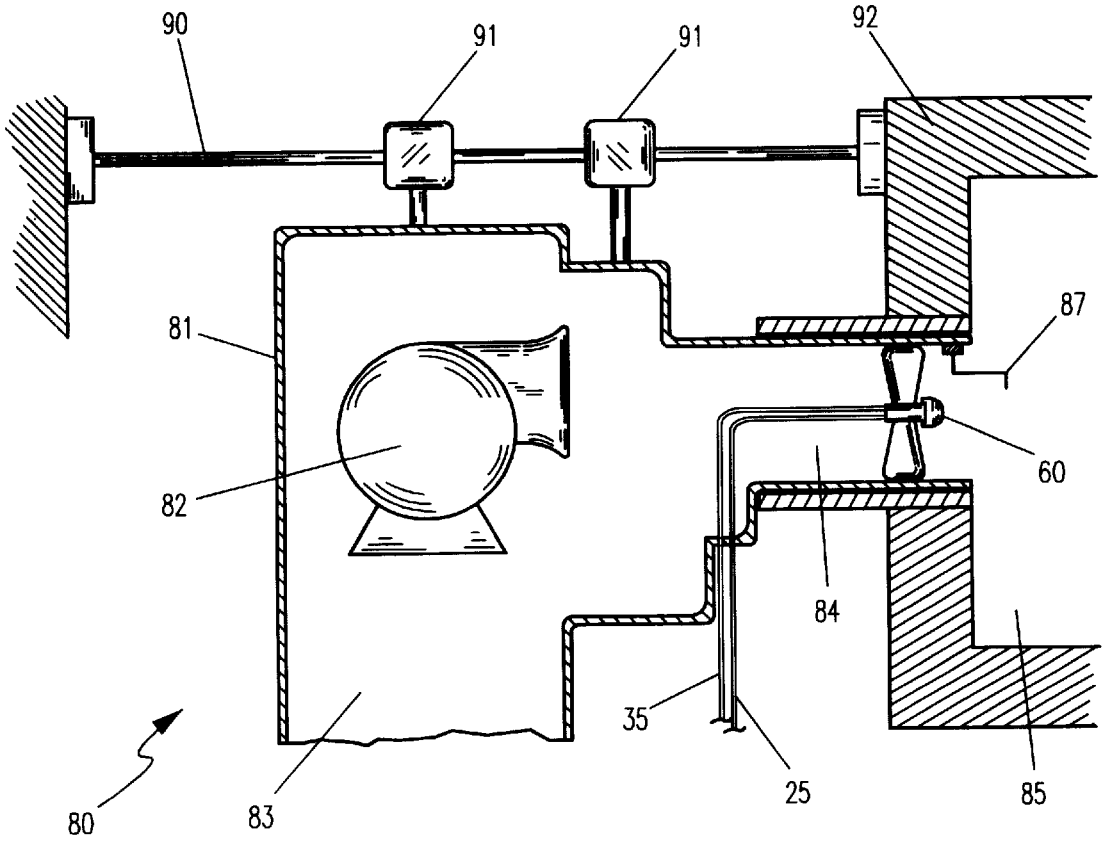
FIG. 9 is a side section view of a sliding drawer type oil burner configuration equipped with an air-purged, high pressure, oil-burning nozzle, according to the preferred embodiment of the present invention.

Referring now to FIG. 9, depicted is a side section view of a sliding drawer type oil burner configuration, hereinafter sliding drawer burner 80, equipped with a purging burner nozzle 60, thereby resulting in a multi-oil burner 30 configuration according to the preferred embodiment of the present invention. It is envisioned that the multi-oil burner 30 configuration of the present invention can be embodied in a new installation burner configuration or in a retrofit scenario where oil burners previously capable of firing only low viscosity heating oils are modified so as to allow for high viscosity and waste oil burning. Fixed drawer burners (not shown) are representative of a burner configuration used in the industry today. The utilization of the purging burner nozzle 60 in a sliding drawer burner 80 offers the advantage of quick access for installation and maintenance functions. However, it should be understood that the incorporation of the purging burner nozzle 60, along with the aforementioned components that make up the multi-oil burner 30, can be incorporated into a variety of alternative burner designs, producing a configuration of similar functionality. The sliding drawer burner 80 includes a burner housing 81 that houses a combustion air fan 82 used to draw combustion air from an air inlet duct 83, forcing the air through the burner duct 84 and into the furnace combustion chamber 85 where it is mixed with atomized oil and ignited. The purging burner nozzle 60 is mounted inside the burner duct 84, centered within an air spinner 86, creating turbulence that aids in atomization of the oil, mixing it with the combustion air in order to promote a complete burn. Because of the inability of many oils to support continuous combustion, a constant spark ignitor 87 provides continuous ignition of the air/fuel mixture. Installation of the purging burner nozzle 60 requires that a fuel delivery conduit 25 and an air line 35 be installed in the sliding drawer burner 80. While the fuel delivery conduit 25 will most likely be available from the previous configuration in the retrofit scenario, new installation of the air line 35 may be necessary.

The nature of the sliding drawer burner 80 is such that it is supported by horizontal support bars 90. The sliding drawer burner 80 is suspended from the support bars 90 by sliding support bushings 91, connected to the burner housing 81, that allow the entire sliding drawer burner 80 to traverse horizontally such that the burner duct 84 can be inserted through the furnace sidewall 92. This configuration allows for easy access to the purging burner nozzle 60 and the constant spark ignitor 87 for routine maintenance and cleaning, although the need for cleaning will be greatly reduced by the present invention.

2. Operation of the Preferred Embodiment

Referring now to the Figures, the multi-oil burner 30 is used to allow for the burning of oils of varying viscosities and qualities, ranging from high viscosity and waste oils to low viscosity and heating oils. The oil is stored in the oil supply tank 21 from which it is transported to the oil pre-heater 31 by the fuel delivery pump 22. Once the system is activated, the fuel delivery pump 22 fills the oil pre-heater 31 and creates a positive fuel pressure within the system. Depending upon the flow characteristics of the oil being used, the thermostat can be used to control the heating element 46, heating the oil to the requisite temperature that will produce the desired flow characteristics. With the fuel isolation/purge valve 36 in the burner position, the oil is delivered to the oil burner 24 where it is sprayed through the purging burner nozzle 60, atomized, mixed with combustion air and ignited.

A fail-safe control system will be incorporated in the multi-oil burner 30, providing intrinsic safety measures that create inter-component lock-outs that prevent their operation in a dangerous condition. Also, fuel flow and ignition will be prevented until combustion air flow is established for a predetermined period of time in order to prevent fire or explosion. Various other safety requirements, well recognized in the field of combustion control and defined in regulatory acts such as the National Fire Prevention Act (NFPA), will be incorporated into the control system in order to further enhance its operational safety.

During operation, the flame intensity and amount of heat delivered to the furnace will be regulated by the control system, by manipulating the speed of the fuel delivery pump 22 in a positive displacement configuration or by actuating the fuel isolation valve 23 in a variable displacement configuration. When the multi-oil burner 30 is shut down, the control system will automatically perform a purge cycle in which the fuel isolation/purge valve 36 will switch to the blowdown tank 37 position and the purge air isolation valve 34 will open. The air will be blown through the purge air conduit 73, into the nozzle head interior cavity 66, back through the nozzle head inlet apertures 72 and the nozzle strainer 71, removing particulate matter and carbonization build-up and transporting it to the blowdown tank 37. While the multi-oil burner 30 is shut down, the pre-heater tank 40 can be cleaned of any carbonization build-up by operating the cleaning plunger assembly 50 and the tank scraping spring 56.

While the preferred embodiments of the invention have been shown, illustrated and described, it will be apparent to those skilled in this field that various modifications may be made in these embodiments without departing from the spirit of the present invention or the teachings of the present disclosure. It is for this reason that the scope of the invention is set forth in and is to be limited only by the following claims.

What is claimed is:

1. An oil burner system that allows for the burning of oils of varying viscosity, said oil burner system comprising:

a fuel pre-heater, having an internal sidewall de-scaling means, in fluid communication with a fuel source;

a three-way fuel-diverting means having a diverter inlet, a blowdown diverter outlet and a burner diverter outlet, said three-way fuel-diverting means capable of being selectably actuated between a blowdown position and a burner position, said diverter inlet in fluid communication with said fuel pre-heater;

a blowdown tank, said blowdown tank comprising a liquid storage vessel in fluid communication with said blowdown diverter outlet; and a burner assembly, in fluid communication with said burner diverter outlet and a pressurized air supply and having a high-pressure fuel burner nozzle with back-washing capabilities;

wherein said oil burner system reduces maintenance by trapping particulate matter within said high-pressure fuel burner nozzle and back-washing said particulate matter into said blowdown tank rather than requiring routine disassembly for cleaning purposes.

2. The oil burner system of claim 1 wherein said fuel pre-heater further comprises an external regulated heat source in physical contact with the exterior surface of said fuel pre-heater and distributed thereabout in order to lower the watt density and reduce the amount of resulting carbonization, and wherein a variable heating element allows the viscosity of the fuel contained within said fuel pre-heater to be adjusted.

3. The fuel pre-heater of claim 2, wherein said internal sidewall descaling means further comprises a plunger handle connected to a plunger stem that extends vertically dawn into the interior cavity of said fuel pre-heater through a plunger aperture centered on a pre-heating tank lid, said plunger aperture allowing said plunger stem to slide freely therein in a longitudinal direction, while forming a hermetic seal therewith, said plunger stem being of a length sufficient to allow it to reach the bottom of said fuel pre-heater and having a pair of tank cleaning rings attached to the bottom thereof, said tank cleaning rings bring generally disc-like in shape and of a diameter sufficient to allow them to slide freely within said fuel pre-heater with minimal clearance and being separated by a tank scraping spring arranged longitudinally about the circumference of said tank cleaning rings, said tank scraping spring being of a size such that it is compressed inside said fuel pre-heater, biasing itself against the fuel pre-heater interior sidewall, wherein actuating said plunger in a longitudinal direction causes said tank scraping spring to remove carbonization build-up from said fuel pre-heater interior sidewall.

4. The oil burner system of claim 1 wherein said burner position of said three-way fuel-diverting means further comprises said diverter inlet in fluid communication with said diverter burner outlet.

5. The oil burner system of claim 1 wherein said blowdown position of said three-way fuel-diverting means further comprises said blowdown diverter outlet in fluid communication with said diverter burner outlet.

6. The oil burner system of claim 1 wherein said blowdown tank comprises a liquid storage vessel having blowdown tank draining means.

7. The oil burner system of claim 1 wherein said high-pressure fuel burner nozzle further comprises generally cylindrical nozzle housing with a first end opposite a second end and in fluid communication one another forming a hollow interior cavity, said first end having a fuel inlet port and an air inlet port therein and said second end having a fuel spraying outlet isolated from said hollow interior cavity by a fuel filtering screen wherein, during burner operation, said fuel enters said hollow interior cavity through said fuel inlet port and passes through said fuel filtering screen, exiting through said fuel spraying outlet.

8. The oil burner system of claim 7 wherein said air inlet port further comprises an external air line connector and a filter screen back-washing air line that enters into said hollow interior cavity terminating therein between said fuel filtering screen and said fuel spraying outlet, wherein said external air line is connected to a compressed air source.

9. The oil burner system of claim 7 wherein said fuel filtering screen further comprises a wire mesh material.

10. The oil burner system of claim 1 wherein said fuel source further comprises a fuel pumping means.

11. The oil burner system of claim 1 wherein, during burner operation, said three-way fuel diverting means is actuated to said burner position, said fuel pumping means delivers said fuel to said fuel pre-heater, filling it and creating a positive pressure therein, said fuel pre-heater heating said fuel to a temperature and viscosity sufficient to ensure proper flow and aspiration and delivering the pressurized fuel to said high-pressure fuel burner nozzle, said pressurized fuel entering through said fuel inlet port, passing through a fuel filtering screen whereby particulate matter is separated from said pressurized fuel and trapped thereon, said pressurized fuel exiting through said fuel spraying aperture, producing a fine mist of fuel that is ideal for combustion.

12. The oil burner system of claim 1 wherein, upon the shutdown of said burner system, said three-way fuel diverting means is actuated to said blowdown position and a compressed air supply is activated, causing pressurized air to be delivered into said high-pressure fuel burner nozzle via a filter screen back-washing air line, passing through a particulate filtering screen in a direction opposite that of said pressurized fuel, backwashing said particulate filtering screen and flushing the particulate matter deposited thereon from said high-pressure fuel burner nozzle into said blowdown tank wherein said particulate matter can be removed via said blowdown tank draining means for disposal.

* * * * *